United States Patent [19]

Foster

[11] Patent Number: 4,982,715

[45] Date of Patent: Jan. 8, 1991

[54] SUPPLEMENTAL FUEL VAPOR SYSTEM

[76] Inventor: Paul M. Foster, 1209 Turner St., P.O. Box 1693, Ashland, Ky. 41101

[21] Appl. No.: 51,247

[22] Filed: May 15, 1987

[51] Int. Cl.[5] ..... F02M 39/00

[52] U.S. Cl. ..... 123/518; 123/523; 123/575

[58] Field of Search ..... 123/518, 516, 519, 520, 123/521, 575–578

[56] References Cited

U.S. PATENT DOCUMENTS

| | | | |
|---|---|---|---|
| Re. 26,169 | 3/1967 | Hall . | |
| 3,391,679 | 7/1968 | Williams et al. . | |
| 3,656,463 | 4/1972 | Kranc . | |
| 3,658,042 | 4/1972 | Balluff . | |
| 3,665,906 | 5/1972 | DePalma . | |
| 3,675,634 | 7/1972 | Tatsutomi et al. . | |
| 3,683,597 | 8/1972 | Beveridge et al. . | |
| 3,696,799 | 10/1972 | Gauck . | |
| 3,745,984 | 7/1973 | King | 123/520 |
| 3,884,204 | 5/1974 | Krautwurst et al. . | |
| 3,949,720 | 4/1976 | Zipprich et al. . | |
| 3,957,025 | 5/1976 | Heath et al. . | |
| 4,003,358 | 1/1977 | Tatsutomi et al. . | |
| 4,013,054 | 3/1977 | Balsley et al. . | |
| 4,079,717 | 3/1978 | Shirose . | |
| 4,159,698 | 7/1979 | Berenbaum . | |
| 4,177,779 | 12/1979 | Ogle . | |
| 4,318,383 | 3/1982 | Iritani | 123/520 |
| 4,326,489 | 4/1982 | Heitert | 123/520 |

*Primary Examiner*—Carl Stuart Miller

*Attorney, Agent, or Firm*—Burns, Doane, Swecker & Mathis

[57] ABSTRACT

A vapor utilization fuel system directs fuel vapor from a vehicle's fuel tank to an intake manifold on the vehicle's engine. The vapor is combusted in the normal course of engine operation. In one embodiment, a mixing canister combines additional air with the fuel vapor; the mixing canister is located on the fuel tank's fill tube. In a second embodiment, the fuel vapor can flow to either the intake manifold or to a conventional carbon canister when the engine is not running.

3 Claims, 2 Drawing Sheets

SUPPLEMENTAL FUEL VAPOR SYSTEM

This application is a continuation application of prior application Ser. No. 706,907 filed on Mar. 1, 1985 which is a continuation of prior application Ser. No. 384,530 filed on June 3, 1982, both now abandoned.

BACKGROUND OF THE INVENTION

1. Field of the Invention

The invention relates to a fuel vapor utilization system which can be used on a conventional automobile with an internal combustion engine. Vapors from a fuel tank are combusted in the normal course of engine operation to cause an increase in fuel efficiency; fuel which would otherwise be lost through vaporization to the atmosphere is used to power the engine. In addition, air pollution is reduced by preventing uncombusted hydrocarbons from escaping to the atmosphere.

2. Description of the Prior Art

Concerns about fuel efficiency and air pollution have caused the development of various devices which prevent the uncombusted fuel vapor in a fuel tank from escaping into the atmosphere. Examples of such devices are a catalytic converter housed in an exhaust manifold exemplified by Balluff, U.S. Pat. No. 3,658,042, conduit and valve systems which are disposed between the fuel tank and carburetor and exemplified by Williams et al, U.S. Pat. No. 3,391,679, a vacuum accumulator exemplified by Heath et al, U.S. Pat. No. 3,957,025, and a carbon canister as exemplified by Beveridge et al, U.S. Pat. No. 3,683,597.

SUMMARY OF THE INVENTION

The instant invention provides an inexpensive and effective solution to the concerns of fuel efficiency and air pollution which arise from the vaporization of fuel stored in a fuel tank. Two preferred embodiments are disclosed.

One preferred embodiment uses a mixing canister to combine air with vaporized fuel. The fuel vapor is passed from the fuel tank to the mixing canister through a portion of the fuel tank's fill tube. From the mixing canister, the vaporized fuel proceeds to the engine's intake manifold by way of a flexible line which connects in a "T" shaped arrangement with a conventional conduit between the PCV valve and a carburetor inlet upstream from the intake manifold.

The second embodiment uses the fuel tank itself to combine air with fuel vapor which then flows to the intake manifold as described above. In both embodiments it is understood that vacuum from the engine operation draws the supplemental fuel into the induction system. It can also flow to a conventional carbon canister which is effective in preventing air pollution from uncombusted hydrocarbons when the engine is not running. A valve prevents the vapor from passing into the engine when the engine is not running. In addition, both embodiments employ a valve in the vapor line which acts as a flow regulator.

DETAILED DESCRIPTION OF THE INVENTION

Figure 1:
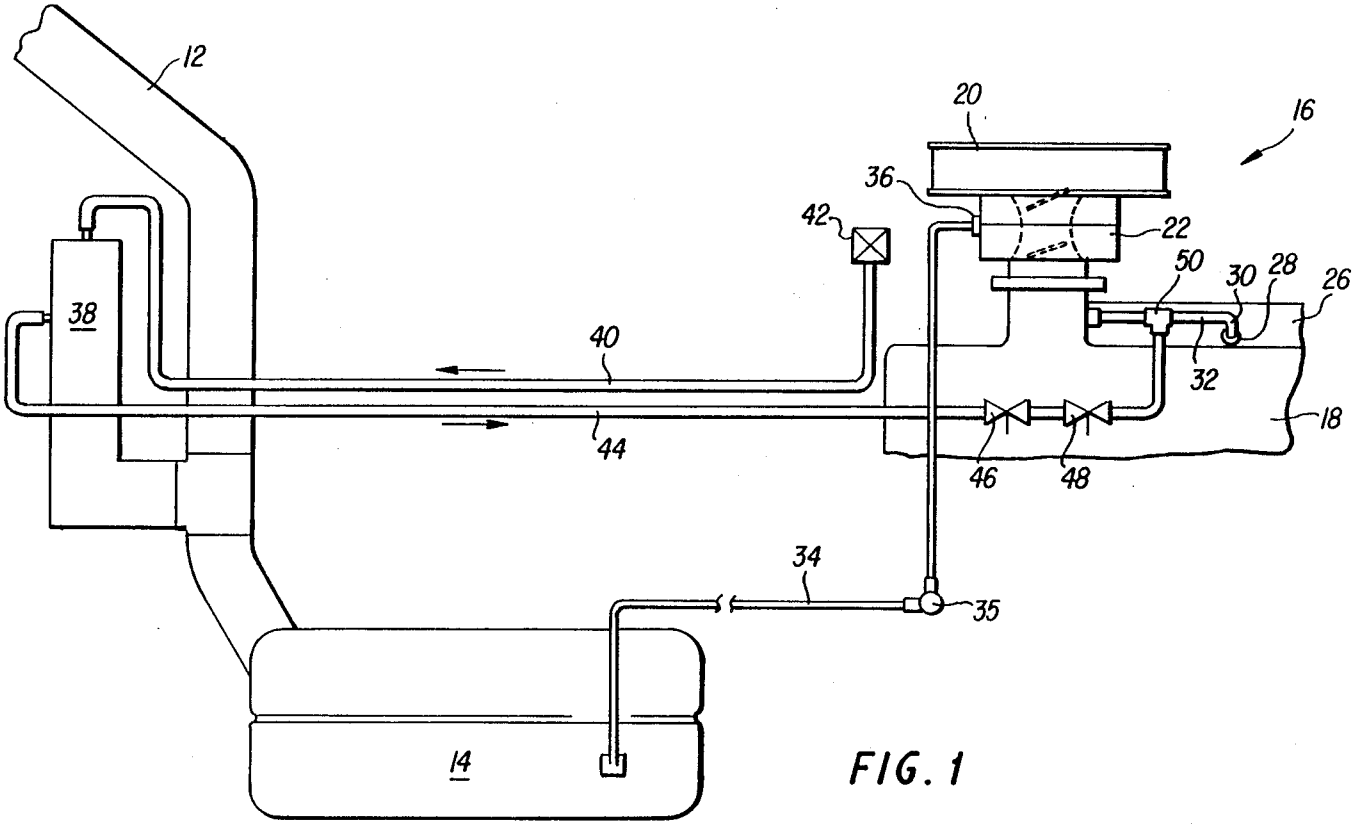
FIG. 1 is a schematic illustration of the first embodiment of the vapor utilization fuel system.

FIG. 1 illustrates the first embodiment of the system as it would be used in an automobile. A fill tube, indicated at 12, serves as a conduit to a fuel tank 14. The fuel is supplied to the fill tube 12 and, ultimately to the fuel tank by any conventional and well known manner. Also, access to the fill tube may be made available by any conventional construction.

An internal combustion engine 16, shown in pertinent partial view, includes an engine block 18 and an air cleaner 20 mounted atop a carburetor 22 which supplies an air/fuel mixture, in a predetermined ratio, to an intake manifold 24 which is indicated by dashed lines. Valve cover 26 has an opening 28 for receiving a conventional PCV valve 30. The valve 30 is connected by a conduit, PCV line 32, to the intake manifold 24. A conventional fuel line 34 is connected between the fuel tank 14 and the carburetor inlet connection 36. A fuel pump 35 pumps the fuel from the tank 14, the fuel line 34 and, ultimately, to the carburetor 22 where it is mixed, in a predetermined proportion, with air which passes through the air cleaner 20. The vapor and fuel droplets are drawn into the combustion chamber, not shown, and ignited.

A mixing canister 38 is connected to the fill tube 12 intermediate the inlet end and the outlet end of the fill tube 12 leading to the tank 14. Connected to the uppermost portion of the vertically extending mixing canister 38 is an air intake line 40 which supplies ambient air to the mixing container 38. At the inlet end of the conduit 40, opposite the end which is connected to the canister 38 is a vapor check valve 42 which prevents the fuel vapor from escaping from the mixing canister. The mixing canister is approximately 1½" in diameter X approximately 4" high. The conduit 40 is approximately 3/8" I.D. A second conduit, supplemental fuel vapor line 44, extends between the lower section of mixing canister 38 and the PCV line 32. This conduit is also approximately 3/8" I.D. A "T" shaped connector 50 is used to join conduit 44 to conduit 32. A flow regulator 46 and a check valve 48 are located in the conduit 44. The flow regulator 46 is a manually adjustable valve which allows the amount of supplemental fuel, entering the intake manifold 24, to be predetermined, depending upon the ratio of fuel delivered to the carburetor 22 through the conventional fuel line 34. The check valve 48 prevents vapors, from the supplemental fuel vapor line 44, from passing into the engine 16 when the engine is not running. The mixing canister supplies a 20:1 vapor to air fuel mixture to the supplemental fuel vapor line 44 for delivery to the intake manifold 24. This was determined by using the following constants:

(1) Average ambient air temperature—50° F.;
(2) Average ambient fuel temperature—50° F.; and,
(3) 40 PSI vacuum from the canister to the intake manifold.

In operation, the system functions to continuously supply a supplemental fuel vapor from the conduit 44 to the intake manifold in order to decrease the amount of liquid fuel supplied by the conventional fuel line 34 to the carburetor 22. When the engine is in operation, the existing vacuum in the intake manifold draws the supplemental fuel into the induction system. By use of the dual fuel delivery system, the amount of fuel supplied by the conventional means from the fuel tank 14, through the fuel line 34 to the carburetor 22 may be decreased while additional fuel, already in the form of fuel vapor, is delivered to the intake manifold by conduit 44. This allows for more efficient fuel combustion and ignition of the fuel/air mixture supplied by conventional fuel line 34 and carburetor 22.

Figure 2:
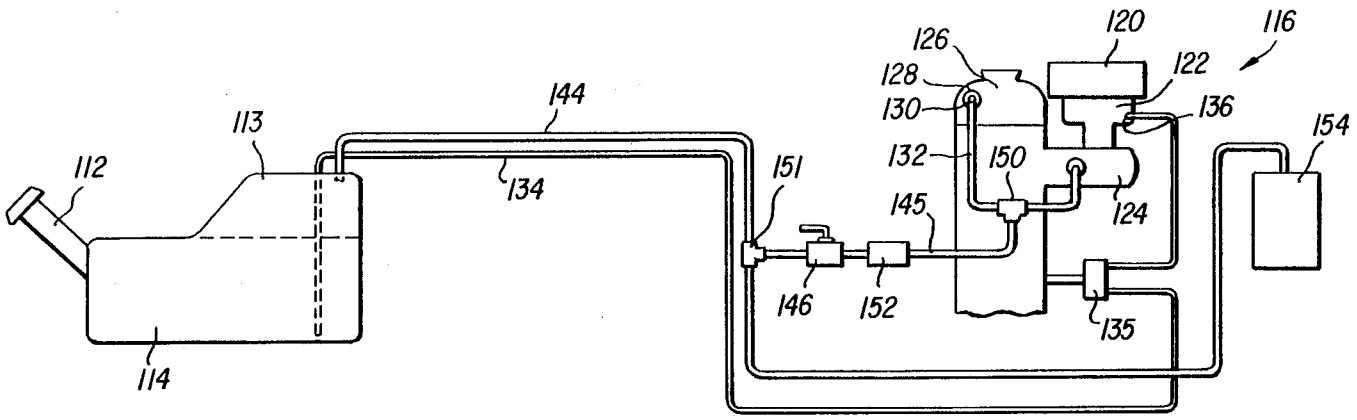
FIG. 2 is a schematic illustration of the second embodiment of the vapor utilization fuel system.

FIG. 2 illustrates the second embodiment of the system as it would be used in an automobile. A conventional internal combustion engine 116 includes an air cleaner 120 mounted atop a carburetor 122 which supplies an air/fuel mixture to an intake manifold 124. Valve cover 126 has an opening 128 for receiving a conventional PCV valve 130. The valve is connected by a conduit, PCV line 132, to the intake manifold 124. A conventional fuel line 134 is connected between the fuel tank 114 and the carburetor inlet connection 136. A fuel pump 135 pumps the fuel through the fuel line 134 from the tank 114 to the carburetor 122 where it is mixed, in a predetermined proportion, with air which passes through the air cleaner 120.

The fuel tank 114 includes an upper portion 113 which acts as a vapor separator. The tank is designed so that the upper portion will never be full of liquid fuel. This is done by stationing this area above the fill tube. Fuel vapors combine with air that is admitted through existing vents in the fuel tank (not shown). A conduit, supplemental fuel vapor line 144 extends between the upper portion 113 of the fuel tank 114 and a carbon canister 154 which processes the uncombusted hydrocarbons through its known absorption system. Connected between the supplemental fuel vapor line 144 and PCV line 132 is an intermediate conduit 145. The conduit 145 is joined to line 144 by a "T" shaped connector 151 and to line 132 by a "T" shaped connector 150. A flow regulator 146 and a check valve 152 are located in the intermediate conduit 145 downstream of the "T" shaped connector 151. The flow regulator valve 146 is the same type of manually adjustable valve as valve 46 of the FIG. 1 embodiment.

The check valve 152 prevents the fuel vapor from flowing into the engine 116 when the engine 116 is not running. Instead, the uncombusted hydrocarbons are processed in a conventional manner by the carbon canister 154. This dual operation provides for the elimination of air pollution in two ways; it accommodates the needs of a fuel system most efficiently both when the engine is running when the fuel vapor is used by the engine and when the engine is not running, when the fuel vapor is processed by the carbon canister.

While the invention has now been described in terms of certain preferred embodiments, the skilled worker in the art will recognize that there are various changes, omissions, modifications, and substitutions that may be made without departing from the spirit thereof. Accordingly, it is intended that the scope of the present invention be limited solely by that of the following claims;

What is claimed is:

1. A supplemental fuel system utilizing fuel vapor, comprising: an internal combustion engine including a carburetor and an intake manifold; a fuel tank provided with air vents; a fuel conduit having a first end connected to said fuel tank and in communication with liquid fuel in said tank and a second end connected to said carburetor; said fuel conduit delivering said liquid fuel to said carburetor from said fuel tank; a fuel vapor conduit having a first end connected to said fuel tank at a location displaced from contact with said liquid fuel and a second end connected to a carbon canister; a PCV conduit having a first end connected to a pollution control valve and a second end connected to said intake manifold; and, an intermediate fuel vapor conduit having a first end connected to said fuel vapor conduit and a second end connected to said PCV conduit; wherein said air vents continuously provide air to said tank to mix with said liquid fuel and form fuel vapor, said fuel vapor drawn from said fuel tank by vacuum developed in said intake manifold and flows through said fuel vapor conduit, said intermediate fuel vapor conduit and said intake manifold to combustion chambers of said internal combustion engine so as to supplement fuel delivered to said engine by said fuel conduit, said liquid fuel and said fuel vapor constantly delivered to said engine during normal operation.

2. A supplemental fuel system as defined in claim 1, further including a flow regulator valve in said intermediate fuel vapor conduit for regulating the supplemental fuel vapor flow to said intake manifold.

3. A supplemental fuel system as defined in claim 1, further including a check valve in said intermediate fuel vapor conduit to prevent the supplemental fuel vapor from flowing to said intake manifold when said engine is inoperative.

* * * * *